United States Patent [19]

Lee et al.

[11] Patent Number: 4,734,998

[45] Date of Patent: Apr. 5, 1988

[54] METHOD AND APPARATUS FOR DEHYDRATING TOXIC CHEMICAL SLUDGE

[75] Inventors: William F. Lee, Hartsville, Tenn.; Roy E. Grubbs, Waxahachie, Tex.

[73] Assignees: Jimmy Wells Needham; Joseph Needham; Jack Newton Needham, all of Lancaster, Tex.

[21] Appl. No.: 816,442

[22] Filed: Jan. 6, 1986

[51] Int. Cl.[4] ..... F26B 3/02

[52] U.S. Cl. ..... 34/33; 34/56; 34/183; 432/111; 432/118; 210/770

[58] Field of Search ..... 34/179, 183, 56, 33, 34/182; 432/110, 111, 118; 110/222; 210/179, 180, 770; 241/152 A, 154, 158, 159, 235

[56] References Cited

U.S. PATENT DOCUMENTS

| | | | |
|---|---|---|---|
| 176,351 | 4/1876 | Rawson | 432/66 |
| 215,192 | 5/1879 | Wilson | 432/154 |
| 415,185 | 11/1889 | Bartlett | 422/156 |
| 511,184 | 12/1893 | Anderson | 432/154 |
| 536,277 | 3/1895 | Forrester | 432/154 |
| 569,821 | 10/1896 | Dickson . | |
| 1,008,256 | 11/1911 | Gnadt | 34/48 |
| 1,256,703 | 2/1918 | Landers | 432/154 |
| 1,270,307 | 6/1918 | Leyes | 432/86 |
| 1,303,114 | 5/1919 | Richardson | 432/67 |
| 2,211,733 | 8/1940 | Soderberg | 423/332 |
| 2,644,681 | 7/1953 | Scull, II et al. | 432/152 |
| 3,044,182 | 7/1962 | Steffen . | |
| 3,109,392 | 11/1963 | Riepl et al. . | |
| 3,553,846 | 1/1971 | McKenzie et al. | 34/56 |
| 3,702,596 | 11/1972 | Winther . | |
| 3,716,339 | 2/1973 | Shigaki et al. | 110/222 |
| 3,744,145 | 7/1973 | Maxwell et al. . | |
| 3,910,775 | 10/1975 | Jackman . | |
| 3,981,455 | 9/1976 | Kaczmarek . | |
| 4,038,021 | 7/1977 | Bensen | 432/118 |
| 4,125,437 | 11/1978 | Bacon | 432/110 |
| 4,222,987 | 9/1980 | Keller | 422/150 |
| 4,338,869 | 7/1982 | Hoskinson . | |
| 4,430,057 | 2/1984 | Hoover et al. | 432/154 |
| 4,504,222 | 3/1985 | Christian . | |
| 4,606,283 | 8/1986 | Desormeaux et al. | 34/179 |
| 4,643,108 | 2/1987 | Singelyn et al. . | |

FOREIGN PATENT DOCUMENTS

| | | | |
|---|---|---|---|
| 360471 | 4/1906 | France | 34/183 |

*Primary Examiner*—Albert J. Makay
*Assistant Examiner*—David W. Westphal
*Attorney, Agent, or Firm*—Daniel V. Thompson

[57] ABSTRACT

A method and apparatus for same are provided to dehydrate a toxic chemical waste sludge to a powder by an internal heat source and to deposit said powder into a container, said apparatus receiving said sludge from a holding tank hopper having means for wiping said sludge into an auger, said auger serving to feed sludge to said apparatus, and said apparatus having an internal auger to move said dry powder to a storage container.

23 Claims, 3 Drawing Sheets

132
142
144
146
130
136
138
140
12
46
14
82
24
A
102
84
18
22
20
74
10
50
54
252
56
52
58
48
42
26
70
72

METHOD AND APPARATUS FOR DEHYDRATING TOXIC CHEMICAL SLUDGE

TECHNICAL FIELD

The present invention relates to a method and apparatus for dehydrating a toxic chemical sludge into a powder by direct application of thermal energy while said sludge is moved through a furnace by a rotating auger.

BACKGROUND ART

Enterprises engaged in the business of electroplating chrome, nickel and other metals are plagued by residue aqueous solutions of toxic chemical compounds left over after the plating process. Current governmental regulations require that these contaminated aqueous solutions be transported to a remote licensed toxic waste burial site and buried in sealed steel containers. This method of disposing of toxic sludges is time consuming and expensive. Consequently, a need exists for reducing liquid toxic chemical sludges to a dry powdered form that can be buried in plastic bags at a local waste site, thereby avoiding the costs related to disposing of the liquid toxic waste. Specifically, a need exists for an apparatus which can accept toxic chemical wastes in various sludge forms, from hard clay-like substances to viscous liquids, and is capable of dehydrating said substances to a dry powdered form.

Various furnaces for drying or dessicating materials are well known in the art. Certain of these devices, such as U.S. Pat. Nos. 536,277 to Forrester, 511,184 to Anderson, and 1,008,256 to Gnadt contemplate transporting the material to be dried through a furnace heated pipe by means of a rotating auger, said pipe being substantially horizontal and open at both ends to receive wet material and emit the final product. Specifically, they contemplate that the material to be dried be isolated from the hot furnace gases, being heated solely by conduction of heat from said furnace gase to the material through the pipe wall itself. In each of these references the speed of the auger determines the amount of time the wet material is exposed to the heat of the furnace.

Further, the prior art includes devices for roasting vegetable materials, such as U.S. Pat. No. 2,644,681 to Scull, II, et al. Similarly, Scull teaches the transportation of the material to be dried through a closed conduit by means of a rotating auger. The wet material is heated by the walls of the closed conduit by hot furnace gases passing around it on their way to an exhaust vent.

The prior art also teaches the use of auger driven ovens for various metallurgical smelting operations. In particular, U.S. Pat. No. 415,186 to Bartlett teaches the use of such apparatus for refining lead, zinc and antimony ore by smelting, and U.S. Pat. No. 1,256,703 to Landers teaches the removal of mercury vapor by a continuous retort formed by a similar device. Each of these references teaches the use of a retort containing a rotating auger to drive the ore material to be reacted or smelted through a heated zone where said material is isolated from the hot furnace gases by the retort wall.

Modern calciners as taught by U.S. Pat. Nos. 4,222,987 to Keller and 4,430,057 to Hoover, et al. teach the use of a muffle to isolate the rotating augers containing the material to be reacted or dehydrated from the heat source, typically gas-fired burners. Hoover, et al. also teaches a calcining furnace without a muffle, however, the typical prior art reaction or drying tube must be isolated from the hot furnace gasses to prevent chemical reactions or other interaction between the material being dried or smelted and the flue gasses themselves. This is particularly true when food is being processed, ores smelted, or anytime oxidation of the material is a potential problem.

The prior art teaches the feeding of an oven by use of a hopper mounted at the feed end of said oven and located to allow the oven's auger to pick up the material to be dried or reacted. Typically, arrangements are shown by U.S. Pat. Nos. 1,256,703 to Landers and 1,270,307 to Leyes. A problem experienced when feeding a viscous clay-like sludge through an auger mechanism by means of a hopper occurs where the auger tunnels into the sludge and the remaining sludge collapses slowly into the auger's path, or refuses to do so at all, interrupting the delivery of sludge. Consequently, a need exists in the art for wiping the interior of a hopper and forcing a viscous sludge into the path of an auger so that it may be transported and fed into the input of a dehydrating furnace.

SUMMARY OF THE INVENTION

This invention comprises a method and apparatus for transforming a toxic chemical sludge into a dry powder material by use of thermal energy. Specifically, an elongated oven having a sealed end to form a closed vessel and a rotating auger drive means is provided whereby a viscous toxic liquid can be deposited at the lower end of said oven and retained without spilling, be transformed into a dry powder by thermal energy, and be transported to a suitable holding container by said auger. In another aspect, the present invention provides a toxic sludge hopper with means to wipe the interior of said hopper and force said viscous sludge into the path of an auger which serves to force feed said toxic sludge into the oven of the present invention.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figures 1, 4A, 4B:
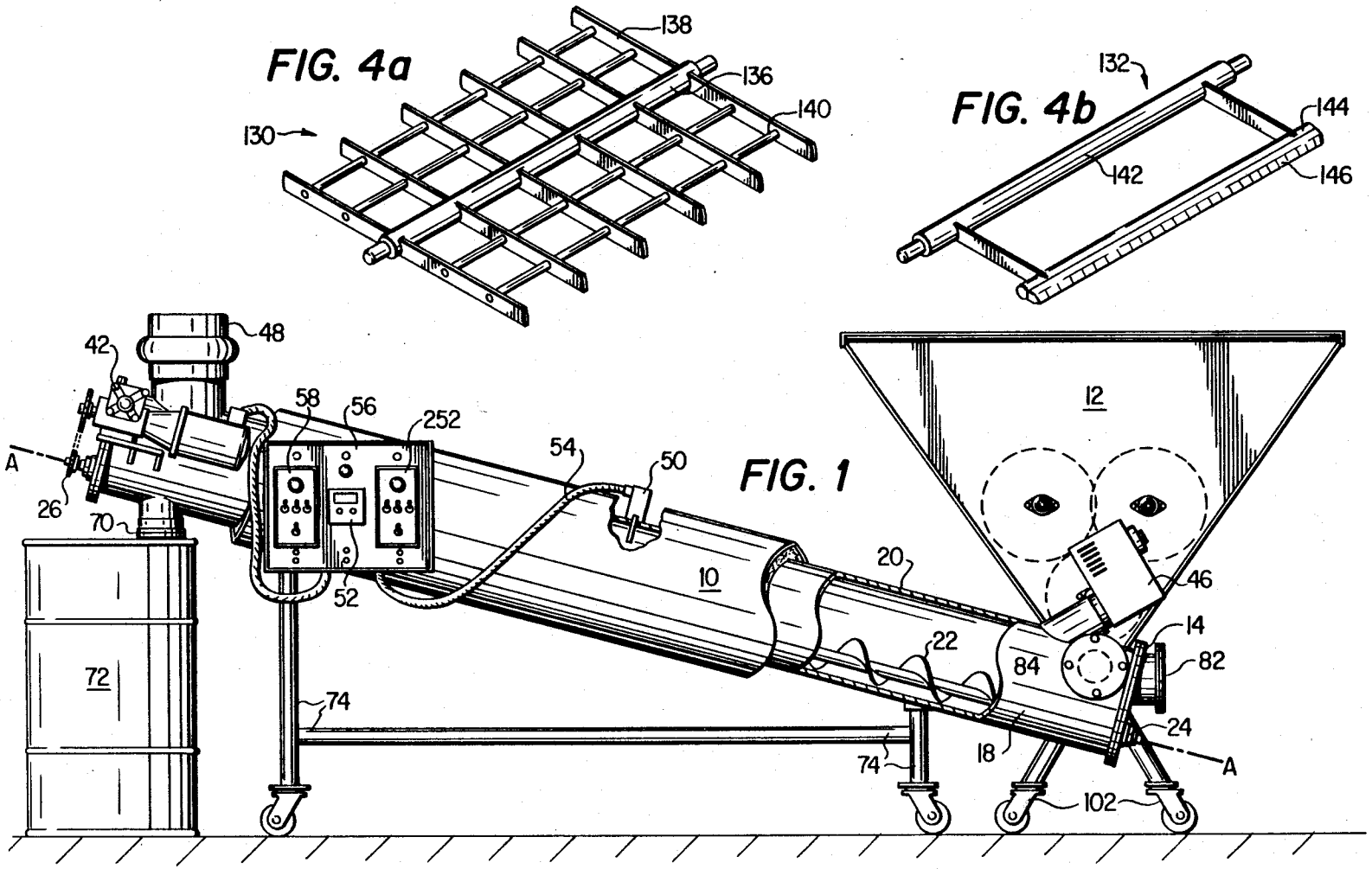
FIG. 1 is a partially broken away side view of the apparatus of the present invention.
FIG. 4*a* is a perspective view of a chopper blade.
FIG. 4*b* is a perspective view of a wiper blade.
Figures 2, 5, 6:
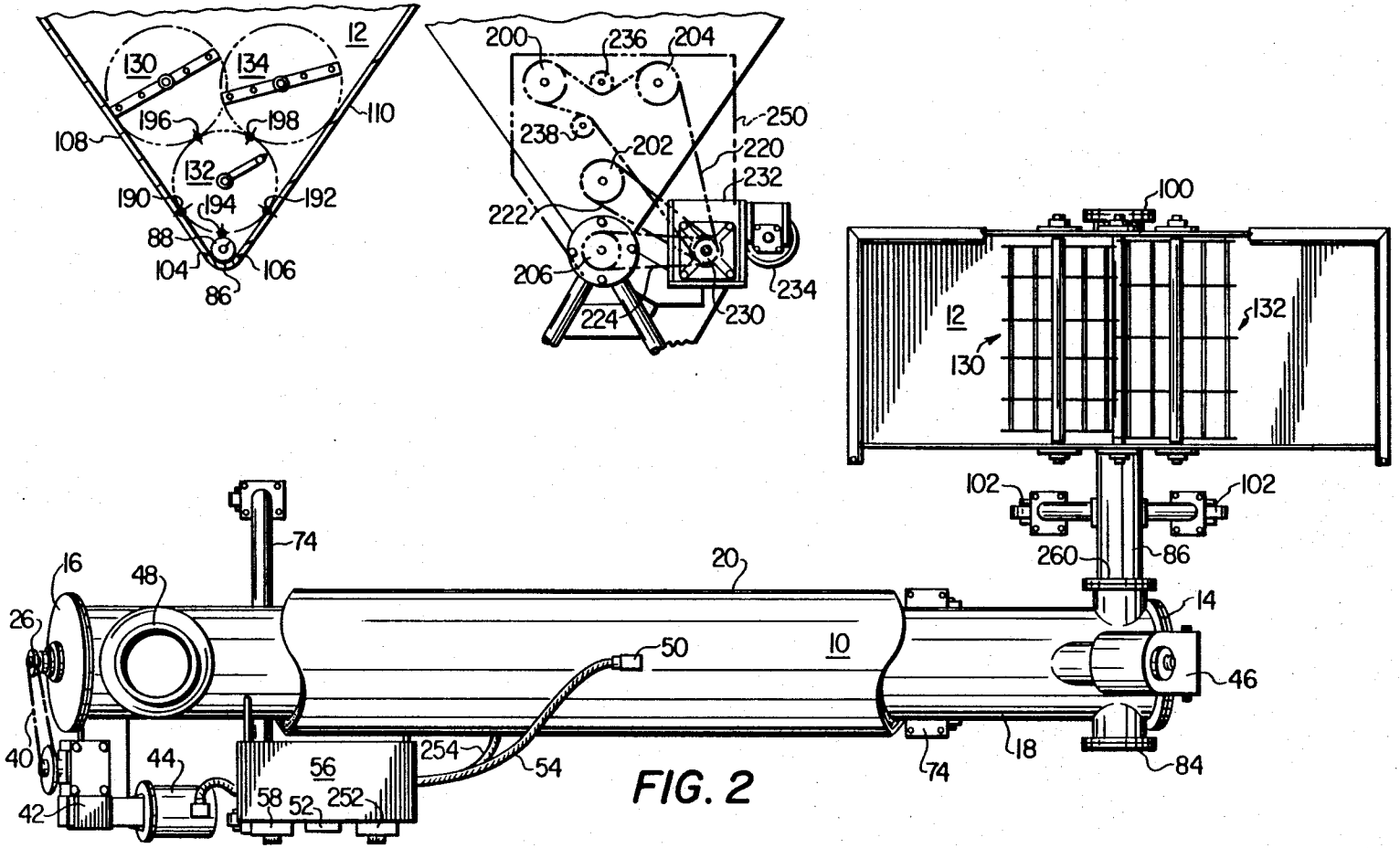
FIG. 2 is a top view of the apparatus of FIG. 1.
FIG. 5 is a partial sectional view taken along lines 5—5 in FIG. 3.
FIG. 6 is a partially broken away side view of the toxic chemical waste hopper.
Figure 3:
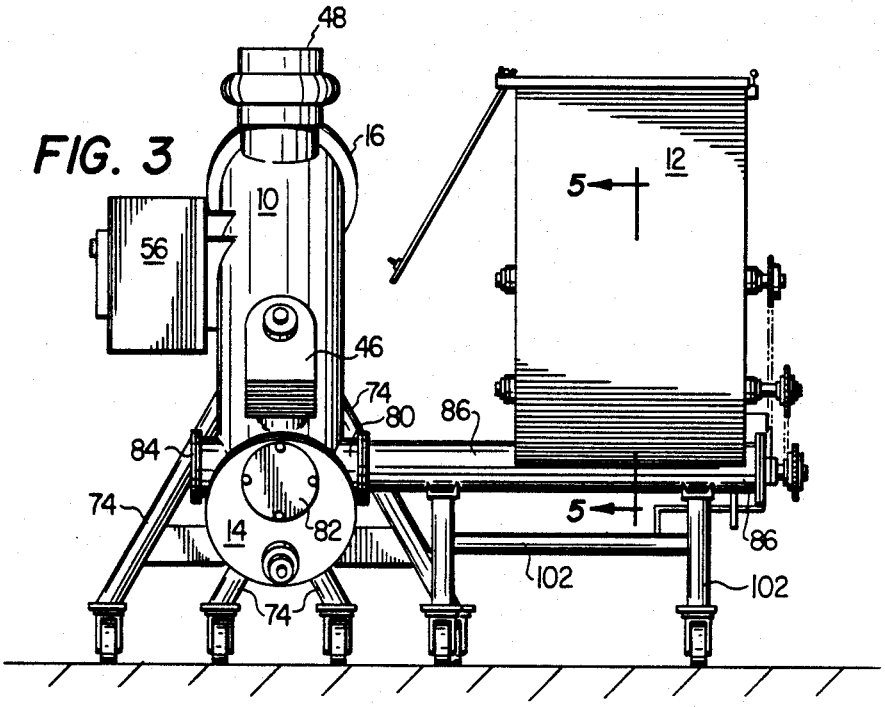
FIG. 3 is an end view of the apparatus of FIG. 1.

Referring initially to FIGS. 1, 2 and 3, the apparatus of the present invention includes inclined oven 10 and hopper 12. Oven 10 has a first and second end plates 14 and 16, has an interior lining 18, and outer insulation 20. In the preferred embodiment, inner lining 18 comprises a steel pipe having an inside diameter of approximately 12 inches, and insulation 20 is made of a double layered insulation blanket rated for 1800° F., and is held in place by a steel boiler skin such as 22 gauge steel. The insulation material is sold under the trade name Cerablanket and is manufactured by Manville Corp. First and second end plates 14 and 16 are made of hot rolled sheet steel of at least ½" thickness. More particularly, first end plate 14 is fastened to the end of interior lining 18 by bolts (not shown) or a weld (not shown) so as to be water tight. Oven 10 rests at an inclined angle of preferably about 15° from the horizontal. This is to provide an area for a liquid sludge to pool at its lower end proximate to end plate 14.

Auger 22 is located in the interior of oven 10 and extends the entire length of said oven, being mounted at first end plate 14 by bearing 24 and at second end plate 16 by bearing 26. Auger 22 is approximately 4.0 inches in diameter and while remaining freely rotatable, touches the bottom interior surface of lining 18. Auger 22 serves to pick up sludge resting in the pool formed by plate 14 at the bottom of oven 10 and transport it through the interior of oven 10 to be subjected to thermal energy. In preferred form, auger 22 has a pitch of 3.5° and is made out of stainless steel.

Auger 22 is driven by a chain and sprocket mechanism 40 located at the elevated end of oven 10. Mechanism 40 in turn is driven by transmission 42 which is powered by electric motor 44. Transmission 42 provides a gear reduction ratio of 150:1, and electric motor 44 has a rating of ¼ hp. In combination, transmission 42 and electric motor 44 serve to drive chain and sprocket mechanism 40 at speeds of up to 1725 rpm. Located in control box 56 is motor control 58 which is used to control the speed of motor 44. Motor control 58 is a conventional DC motor control.

In the preferred embodiment, thermal energy necessary for the operation of the invention is provided by natural gas mixed with air by blower 46. The preferred blower has an output of 250,000 BTU. Alternatively, a propane blower may be used, which generates more heat than the natural gas embodiment, or an electric heater may be used.

As the sludge is dehydrated by the heat produced by blower 46, the resulting water vapor and flue gas is vented through exit port 48. The temperature in the interior of oven 10 is monitored by thermocouple 50 which is connected to thermostat 52. Thermostat 52 is located in control box 56, and preferrably has variable means for presetting a desired temperature and means for providing a digital display of the current temperature within oven 10.

Dried sludge, in the form of a granular powder, is emptied by auger 22 into outlet port 70 located on the bottom side of the uppermost end of oven 10. Outlet port 70 is a passageway which allows the dried powder to fall under the force of gravity into container 72. Wheeled carriage 74 is provided so oven 10 may be portable.

At oven 10's lower end is inlet port 80, and blind ports 82 and 84. Inlet port 80 is connected to hopper 12 by pipe 86 extending between said hopper and said inlet port. Pipe 86 is sized to rotatably receive auger 88 (shown in FIGS. 4 and 5), and is attached to the bottom of hopper 12 in any manner suitable to prohibit spillage or leaking of toxic sludge from said hopper. Pipe 86 is closed at its end furthest from oven 10 by end plate 100. End plate 100 is removable to allow cleaning of pipe 86 and servicing of auger 88. Hopper 12 is mounted on wheel carriage 102 and can be connected to oven 10 at blind ports 82 or 84 depending upon the space available when the machine is in use.

Figure 4:
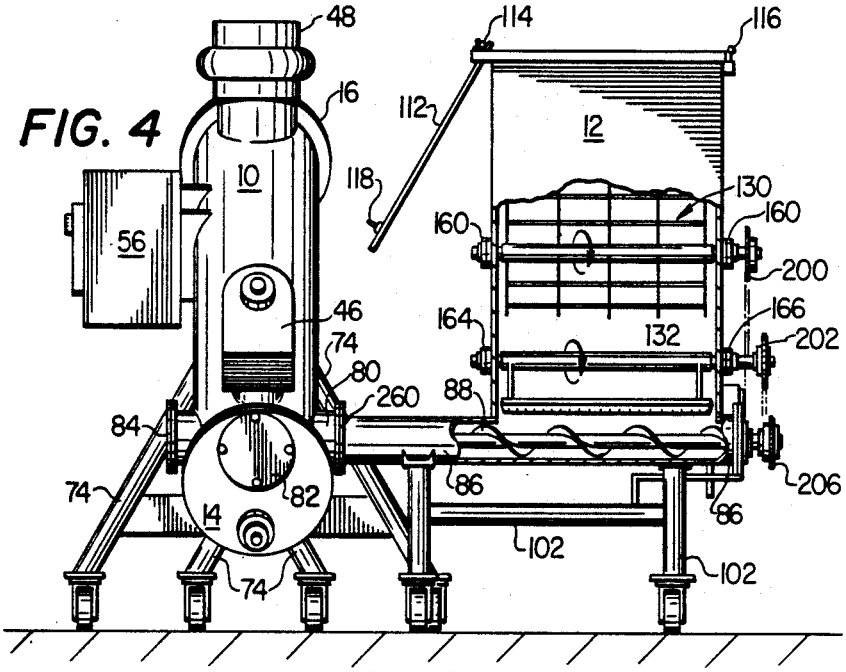
FIG. 4 is a partially broken away end view of the apparatus of FIG. 1.

Referring now to FIGS. 4, 5 and 6, auger 88 lies in the interior of pipe 86, said pipe being cut out so as to expose auger 88 to the interior of hopper 12. Pipe 86's cutout is defined by points 104 and 106 as seen in the sectional view of FIG. 5, said points being the points at which hopper 12's sides 108 and 110 are respectively attached to pipe 86. In the preferred embodiment, sides 108 and 110 are attached to pipe 86 by a weld bead.

Hopper 12 has lid 112 hinged at point 114, serving to cover the open top of hopper 12 during use. Microswitch 116 located on the upper lip of hopper 12 is triggered to its "on" position when 112 is in its closed position by tab 118 located on the inner surface of lid 112. Switch 116 operates as a safety switch, which serves to shut down the apparatus of the present invention if lid 112 is opened during operation.

In its interior, hopper 12 has chopper assembly 130 and wiper assembly 132. In the preferred embodiment, hopper 12 has two chopper assemblies 130 and 134 (as seen in FIG. 2) and has a capacity of 18 cubic feet. As seen in FIG. 4*a* chopper assembly 130 is comprised of shaft 136 which has attached to blade assembles 138 and 140. Referring to FIG. 4*b* wiper assembly 132 is comprised of shaft 142 which has attached to it mount 144, which in turn has located in its center neoprene blade 146 which extends outward. Chopper assembly 130 is mounted by bearings 160 and 162 located at either side of hopper 12. Likewise, wiper assembly 132 is mounted in hopper 12 by bearing assembly 164 and 166.

During operation, wiper assembly 132 revolves about wiper shaft 142 describing circle of rotation 280 which is tangential to hopper sides 108 and 110 at points 190 and 192 respectively. Likewise, this circle of rotation is tangent to auger 88 at point 194, and is also tangent at points 196 and 198 with circles 282 and 284 described by rotating chopper blades 138 and 140 respectively.

Chopper 130's shaft 136 is attached to sprocket 200, and wiper 132's shaft 142 is attached to sprocket 202, and in the preferred embodiment having two chopper assemblies, chopper assembly 134's shaft is attached to sprocket 204. Likewise, auger 88 is attached to sprocket 206 through end plate 100 mounted at the rear of pipe 86. Each of these sprockets is linked to a chain drive: sprockets 202 and 204 by chain 220; sprocket 200 by chain 222; and sprocket 206 by chain 224. Chains 220, 222, and 224 are driven by sprocket 230 which is attached to transmission 232, and driven by motor 234. The speed of motor 234 is controlled by control mechanism 252 located in control box 56 (shown in FIGS. 1, 2 and 3). Transmission 232 provides a reduction ratio of 500:1, and motor 234 has a rating of ¾ horsepower. Chain 220 is tensioned by idlers 236 and 238. The entire chain sprocket assembly is covered by safety cover 250.

In operation, oven 10 is connected to hopper 12 at flange 260. Hopper 12 can be moved on wheeled carriage 102 and can be alternatively attached to blind ports 82 or 84. An aqueous solution of toxic chemicals, reduced to sludge form by partial dehydration in a conventional filter press, is delivered to hopper 12. Typically, these sludges are from 65% to 70% by weight water, but can have higher weight percentages of liquid. Blower 46 is started and the flame ignited to allow oven 10 to preheat and lid 112 is closed so as to trigger switch 116 allowing operation of motor controls 58 and 252. Preferrably, thermostat 52 is set to a temperature of from between about 650° F. and 1400° F. Higher temperatures can be used to dehydrate sludges more quickly, but have the disadvantage of having higher operating costs.

Control 252 is set so as to operate chopper assemblies 130 and 134, wiper assembly 132, and auger 88 to feed sludge to oven 10 at the desired rate. For a relatively dry sludge, control 252 is adjusted so that motor 234 runs at a relatively slow speed because of the difficulty in breaking up the sludge and forcing it into the path of auger 88. Alternatively, with a less viscous liquid or soft sludge, motor control 252 may be adjusted to allow motor 234 to revolve at a higher speed thereby allowing the sludge to be forced into auger 88's path at a faster rate, and consequently delivered to oven 10 at a faster rate. Tunneling is eliminated with the present invention, because wiper 132 serves by its tangential contacts with walls 108 and 110 and choppers 132 and 134 to wipe all stagnant sludge into the path of auger 88. Wiper assembly 132 keeps second auger 88 constantly full of sludge regardless of the sludge's resistance to shear stresses or high viscosity.

Auger 88 delivers the wet sludge to preheated oven 10 through pipe 86. The inner lining 18 of oven 10 and its first end plate 14 are adequately sealed to prevent any liquid from leaking out of oven 10 as it is fed by auger 88. This aspect, in conjunction with oven 10's inclination, serves to pool any liquid sludge at the oven's lower end, allowing it to be dehydrated and moved to the oven's upper end by auger 22 without any spillage or leaking.

The operator carefully adjusts thermostat 52, motor control 56, and motor control 252 to yield a sufficient temperature within the interior of oven 10 and a sufficient rate of revolution of auger 22 to permit sludge delivered by second auger 88 to be moved up the length of oven 10 and be perfectly dry when released by auger 22 into outlet port 70, thereby allowing the powder to fall into receiving barrel 72. The rate of auger 22 and the heat of the oven can be adjusted so that the powder delivered through outlet port 70 is merely warm to the touch, not dangerously hot. Typically, 18 cubic feet of wet sludge of 70% water yields 3½ cubic feet of dry powder in about 10 to 16 hours. Exit port 48 provides an exhaust means for the removal of water vapor and flue gasses to escape from oven 10, and provides trap 290 to allow water vapor to be condensed and collected for analysis to evaluate the operation of the dehydrator.

We claim:

1. Apparatus for dehydrating a toxic chemical sludge comprising:

an oven having an elongated cylindrical body and first and second ends;

a first auger rotatably mounted in the interior of said oven, in proximity to said body's lower inner surface and sized to extend substantially between said oven's first and second ends;

an inlet port at said oven's first end;

an outlet port at said oven's second end positioned to allow exit of a powdered substance from said interior of said oven by the force of gravity;

a heat source adapted for heating said interior of said oven;

first control means for controlling the speed of said first auger;

means for controlling said heat source;

a hopper;

a second auger rotatably mounted in the interior of a pipe extending between said hopper and said body;

said pipe being sized to engage with said inlet port;

second control means for controlling the speed of a higher said second auger between a lower rotational speed and rotational speed; and said first control means and said second control means being independently variable in order to set the speeds of the first and second augers to feed and dehydrate sludges having variable flow characteristics.

2. The apparatus of claim 1 wherein said hopper further comprises:

a bin having at least two sloped walls converging at its lower end to form an opening to receive said second auger;

means for chopping sludge located within said bin comprising at least one chopping element mounted on a rotatable shaft to describe a first circle of rotation;

means for wiping located within said bin comprising at least one wiping element mounted on a rotatable shaft to describe a second circle of rotation;

said means for wiping and said second auger being located so that said second circle of rotation is substantially tangent to said second auger, said means for wiping and said means for chopping being located so that said second circle of rotation is substantially tangent to said first circle of rotation, and said means for wiping being located within said bin so that said second circle of rotation is substantially tangent to said bin's sloped walls.

3. The apparatus of claim 2 wherein said means for wiping further comprises a resilient blade fixably mounted in a rigid mount and located a distance from the shaft sufficient to allow said blade to remove material from said means for cutting, said bin walls, and said second auger.

4. A method of dehydrating toxic chemical sludge comprising the steps of:

loading sludge into a hopper having walls;

chopping said sludge with rotating chopping structure located within said hopper;

wiping chopped sludge into a feeder with rotating wiping structure, said wiping structure having an outer wiping surface, and said wiping surface passing in very close proximity to said chopping structure and said hopper walls during rotation of said wiping structure, such that said wiping surface wipes retained sludge from said chopping structure and said hopper walls into said feeder;

feeding said sludge with said feeder into the lower end of an inclined elongated oven to be received by a main transport;

activating said main transport to move said sludge the length of said inclined oven while heating said sludge to a sufficiently elevated temperature for a time period sufficient to remove substantially all free liquid from said sludge to yield a granular powder;

said main transport being activated to move said granular powder up the length of said inclined elongated oven to be received by an outlet port located on the bottom side of said oven at its more elevated end; and ejecting said granular powder from said outlet port into a suitable container.

5. A feed system for a dehydrator including heating means for heating the interior of the dehydrator, main transport means for transporting material to be dehydrated through the interior of the dehydrator, a controller for varying the speed of the main transport means, and an inlet to the interior of the dehydrator, the feed system comprising:

a hopper for receiving material to be dehydrated through an upper hopper opening and discharging the material through a lower hopper opening;

feed means for continuously feeding material from the lower hopper opening to the inlet to the interior of the dehydrator; and control means for variably controlling the speed of the feed means independently of the controller for varying the speed of the main transport means, such that the speed of the feed means and the speed of the main transport means can be individually set to adapt the dehydrator to varying viscosities of material to be dehydrated.

6. The feed system of claim 5 wherein the feed means comprises a feed auger.

7. The feed system of claim 5 further comprising separate means for chopping the material mounted within the hopper between the upper and lower hopper openings.

8. The feed system of claim 7 further comprising separate means for wiping located within the hopper between the lower hopper opening and the means for chopping.

9. The feed system of claim 8 wherein the means for wiping includes at least one wiping element fixed to a wiping means shaft for rotation within the hopper.

10. The feed system of claim 9 wherein the wiping element includes a resilient blade.

11. The feed system of claim 10 wherein the resilient blade is spaced apart from the wiping means shaft for wiping contact with at least one interior wall of the hopper and the means for chopping.

12. The feed system of claim 8 wherein the means for wiping is disposed in a wiping relationship to at least one interior wall of the hopper.

13. The feed system of claim 8 wherein the means for wiping is disposed in a wiping relationship with a feed auger.

14. The feed system of claim 8 wherein the means for wiping is disposed in a wiping relationship to the means for chopping.

15. The feed system of claim 7 wherein the means for chopping includes a chopper assembly including a chopping means shaft fixed for rotation within the hopper and a plurality of blades attached to the chopping means shaft.

16. The feed system of claim 9 wherein each blade extends radially from the chopping means shaft.

17. The feed system of claim 16 having a plurality of planar blade assemblies extending radially from the shaft, each blade assembly including a plurality of blades fixed in a plane which includes the chopping means shaft and being spaced apart along the length of the chopping means shaft.

18. The feed system of claim 17 wherein the blades in the blade assembly are maintained in a spaced relationship by means of at least one longitudinal member extending between the blades.

19. Apparatus for dehydrating a toxic chemical sludge comprising:

an oven having an elongated cylindrical body and first and second ends;

a first auger rotatably mounted in the interior of said oven, in proximity to said body's lower inner surface and sized to extend substantially between said oven's first and second ends;

an inlet port at said oven's first end;

an outlet port at said oven's second end positioned to allow exist of a powdered substance from said interior of said oven by the force of gravity;

a heat source adapted for heating said interior of said oven;

first control means for controlling the speed of said first auger;

means for controlling said heat source;

a hopper;

a second auger rotatably mounted in the interior of a pipe extending between said hopper and said body;

said pipe being sized to engage with said inlet port;

second control means for controlling the speed of said second auger;

said first control means and said second control means being independently variable in order to set the speeds of the first and second augers to feed and dehydrate sludges having variable flow characteristics;

said hopper comprising a bin having at least two sloped walls converging at its lower end to form an opening to receive said second auger;

means for chopping sludge located within said bin comprising at least one blade mounted on a rotatable shaft to describe a first circle of rotation;

means for wiping located within said bin comprising at least one blade mounted on a rotatble shaft to describe a second circle of rotation; and said means for wiping and said second auger being located so that said second circle of rotation is substantially tangent to said second auger, said means for wiping and said means for chopping being located so that said second circle of rotation is substantially tangent to said first circle of rotation and said means for wiping being located within said bin so that said second circle of rotation is substantially tangent to said bin's sloped walls, such that said means wiping wipes retained sludge from said means for chopping and said hopper walls into said second auger.

20. A feed system for a dehydrator including heating means for heating the interior of the dehydrator, main transport means for transporting material to be dehydrated through the interior of the dehydrator, a controller for varying the speed of the main transport means, and an inlet to the interior of the dehydrator, the feed system comprising:

a hopper for receiving material to be dehydrated through an upper hopper opening and discharging the material through a lower hopper opening;

feed means for feeding material from the lower hopper opening to the inlet to the interior of the dehydrator;

control means for variably controlling the speed of the feed means independently of the controller for varying the speed of the main transport means, such that the speed of the feed means and the speed of the main transport means can be individually set to adapt the dehydrator to varying viscosities of material to be dehydrated;

means for chopping the material mounted within the hopper between the upper and lower hopper openings;

means for wiping located within the hopper between the lower hopper opening and the means for chopping; and the means for wiping being disposed in a wiping relationship to the means for chopping.

21. A feed system for a dehydrator including heating means for heating the interior of the dehydrator, main transport means for transporting material to be dehydrated through the interior of the dehydrator, a controller for varying the speed of the main transport means, and an inlet to the interior of the dehydrator, the feed system comprising:

a hopper for receiving material to be dehydrated through an upper hopper opening and discharging the material through a lower hopper opening, the hopper having walls;

feed means for feeding material from the lower hopper opening to the inlet to the interior of the dehydrator;

control means for variably controlling the speed of the feed means independently of the controller for varying the speed of the main transport means, such that the speed of the feed means and the speed of the main transport means can be individually set to adapt the dehydrator to varying viscosities of material to be dehydrated;

means for chopping the material mounted within the hopper between the upper and lower hopper openings;

means for wiping located within the hopper between the lower hopper opening and the means for chopping; and said means for wiping having an outer surface that describes a circle of rotation, said circle of rotation being in very close association with the means for chopping, the walls of the hopper, and the feed means, to remove sludge from said means for chopping and said walls and wipe sludge into said feed means.

22. A feed system for a dehydrator including heating means for heating the interior of the dehydrator, main transport means for transporting material to be dehydrated through the interior of the dehydrator, a controller for varying the speed of the main transport means, and an inlet to the interior of the dehydrator, the feed system comprising:

a hopper for receiving material to be dehydrated through an upper hopper opening and discharging the material through a lower hopper opening, the hopper having walls;

feed means for feeding material from the lower hopper opening to the inlet to the interior of the dehydrator;

control means for variably controlling the speed of the feed means independently of the controller for varying the speed of the main transport means, such that the speed of the feed means and the speed of the main transport means can be individually set to adapt the dehydrator to varying viscosities of material to be dehydrated;

means for chopping the material mounted within the hopper between the upper and lower hopper openings;

means for wiping located within the hopper between the lower hopper opening and the means for chopping, said means for wiping having an outer surface that describes a circle of rotation, said circle of rotation being in very close association with the means for chopping, the walls of the hopper, and the feed means, to remove sludge from said means for chopping and said walls and wipe sludge into said feed means; and the means for chopping including a chopper assembly including a chopping means shaft fixed for rotation within the hopper and a plurality of planar blade assemblies extending radially from the chopping shaft, each blade assembly including a plurality of blades fixed in a plane which includes the chopping means shaft and being spaced apart along the length of the chopping means shaft.

23. The feed system of claim 22 wherein the blades in the blade assembly are maintained in a spaced relationship by means of at least one longitudinal member extending between the blades.

* * * * *